US006397624B1

(12) United States Patent
Horwell

(10) Patent No.: US 6,397,624 B1
(45) Date of Patent: Jun. 4, 2002

(54) COOLING APPARATUS

(75) Inventor: Richard Horwell, Twickenham (GB)

(73) Assignee: Chilla Limited, Twickenham (GB)

( * ) Notice: Subject to any disclaimer, the term of this patent is extended or adjusted under 35 U.S.C. 154(b) by 0 days.

(21) Appl. No.: 09/720,619

(22) PCT Filed: Jul. 2, 1999

(86) PCT No.: PCT/GB99/02126

§ 371 (c)(1),
(2), (4) Date: Feb. 22, 2001

(87) PCT Pub. No.: WO00/01993

PCT Pub. Date: Jan. 13, 2000

(30) Foreign Application Priority Data

Jul. 2, 1998 (GB) ..... 9814405

(51) Int. Cl.[7] ..... F25D 3/08
(52) U.S. Cl. ..... 62/457.8; 62/457.4; 62/372
(58) Field of Search ..... 62/457.8, 457.4, 62/372, 435

(56) References Cited

U.S. PATENT DOCUMENTS

| | | | | | |
|---|---|---|---|---|---|
| 714,415 | A | * | 11/1902 | Trafford | 62/435 |
| 2,546,417 | A | * | 3/1951 | Anglin | 62/435 |
| 3,888,092 | A | * | 6/1975 | Fisher | 62/376 |
| 4,825,665 | A | * | 5/1989 | Micallef | 62/372 |
| 5,003,787 | A | * | 4/1991 | Zlobinsky | 62/185 |
| 5,005,378 | A | | 4/1991 | Ottenheimer | 62/378 |
| 5,123,262 | A | | 6/1992 | Laude-Bousquet | 62/434 |
| 5,377,878 | A | | 1/1995 | Rainey et al. | 222/146.6 |
| 5,398,520 | A | | 3/1995 | Kamin et al. | 62/376 |

FOREIGN PATENT DOCUMENTS

| | | | |
|---|---|---|---|
| EP | 0 491 671 A1 | | 6/1992 |
| FR | 429 366 | | 9/1911 |
| FR | 682494 | | 5/1930 |
| GB | 1 417 846 | | 12/1975 |
| GB | 1 537 821 | | 1/1979 |
| GB | 2 168 798 B | | 5/1989 |
| GB | 2271416 A | * | 4/1993 |
| GB | 2 271 416 A | | 4/1994 |
| WO | WO-91/02933 A | * | 3/1991 |
| WO | WO 91/02933 | | 3/1991 |
| WO | WO 92/21254 | | 12/1992 |
| WO | WO 93/13372 | | 7/1993 |

* cited by examiner

*Primary Examiner*—William C. Doerrler
(74) *Attorney, Agent, or Firm*—Blank Rome Comisky & McCauley LLP

(57) ABSTRACT

The cooling apparatus (2) for a wine bottle includes a pump (18, 20) for circulating iced water (30) around the inside of chamber (4). A bottle (14) is placed within the chamber (4). The pump (18) may be operated by a timer mechanism (10).

24 Claims, 4 Drawing Sheets

COOLING APPARATUS

This is a National Phase Application of PCT/GB99/02126 filed on Jul. 2,1999, which in turn is based on GB Application 9814405.8 filed Jul. 2,1998, the priority of which is claimed herein.

The present invention relates to a method and apparatus for cooling a container and has particular, although not exclusive, relevance to such a cooling apparatus for use in a domestic environment for cooling wine bottles and the like.

Systems for cooling or chilling bottles of drink have long been known. On a basic level, a bottle to be chilled may be wrapped in a wet cloth. The latent heat of vaporisation of the water is obtained from the body of fluid within the container. This is a common technique for chilling wine bottles and the like on hot summer days.

More complex systems have been proposed, such as those disclosed in U.S. Pat. No. 3,888,092 and GB-A 1,537,821.

The former document shows the use of a chamber containing cooling fluid. A bottle for chilling is placed into the container and partially immersed in the cooling fluid. A refrigeration system is provided to chill the cooling fluid to a temperature sufficiently low to allow rapid chilling of the bottle and its contents.

In the case of the latter document, a bottle for chilling may be placed upon a platform which is immersible in cooling fluid. Once again, a refrigeration apparatus is included to chill the cooling fluid to the required temperature.

Both the above documents, and other similar arrangements in the prior art, have a common feature of firstly chilling the cooling fluid itself to as low a temperature as possible thereby allowing rapid cooling of a bottle or other container. Furthermore, all of these systems include some form of refrigeration apparatus in order to chill the cooling fluid.

There exist various problems with the above approach, however. Such problems include the need to have a bulky system because of the use of a refrigerant apparatus to chill the cooling fluid itself. Common refrigerant systems include a heat exchanger, pump, expansion valves and the like. Furthermore, such a discrete refrigeration system needs to draw power from the mains or from a large battery supply.

In U.S. Pat. No. 4 825 665 a bottle is suspended in a container of iced water and the container is rotated.

In U.S. Pat. No. 5 005 378 a bottle is suspended in a bucket of ice and rotated by a hand drill like mechanism.

In each case there are substantial moving parts and laminar flow will be established around the bottle, reducing the cooling efficiency.

There exists, therefore, the need for a relatively small, simple, and lightweight unit which is simple to operate and transfer heat from the bottle and its contents to the iced water as quickly as possible.

It is thus an object of the present invention to at least alleviate the aforementioned shortcomings by providing cooling apparatus comprising a chamber for receiving a container to be cooled, the chamber arranged to contain cooling fluid for cooling the container within the chamber; the cooling fluid being a mixture of ice and water; the apparatus further comprising means for circulating the cooling fluid within the chamber. It has been found that, by providing a chamber which is able to retain a fluid mixture of ice and water and then circulating the fluid mixture around the container to be chilled, a rapid chilling of the contents of the container is achieved, particularly if turbulent flow is induced.

Preferably the apparatus includes a timer mechanism for controlling duration of the circulating means. Advantageously the chamber includes a thermally insulative wall to prevent heat transfer from the environment outside the chamber with the cooling fluid.

Advantageously the chamber includes a support member on which a container for cooling may be placed. Preferably the circulating means is housed below the support member.

In a preferred embodiment the circulating means is arranged to draw cooling fluid through a first portion of the support member and eject the drawn cooling fluid through a further portion of the support member. This allows directional control of the flow of cooling fluid within the chamber.

Preferably the chamber defines a cylinder and the circulating means drives the cooling fluid around the chamber so that the cooling fluid circulates around the container within the chamber. Preferably the flow of the cooling fluid is substantially turbulent.

Advantageously, the chamber includes a flared portion defining a carrying handle.

Advantageously the thermally insulative wall comprises a double-skinned wall of plastics material with air between the double skins.

Preferably the timer mechanism comprises an adjustable timer which may operate the agitation means when set and stop operation of the agitation means when timed-out.

Preferably the circulation means comprises a pump, which may be a submersible pump. The use of such a pump enables the fluid to be circulated around the chamber.

According to a further aspect of the present invention there is provided a method of cooling a container placed within a chamber comprising;

providing a mixture of ice and water within the chamber, placing the container within the chamber so as to be at least partially immersed in the mixture;

agitating the mixture to circulate about the container.

Preferably the duration of agitation of the mixture is set in dependence upon the required degree of cooling of the container.

Advantageously agitation of the mixture is achieved by pumping the fluid around the chamber.

According to a further aspect of the present invention there is provided a cooling apparatus comprising: a chamber for receiving a container to be cooled and a quantity of ice and water for cooling the container, the chamber dimensioned to receive the container so that a defined space exists between the walls of the chamber and the container; means for circulating of the quantity of ice and water between the container and the chamber walls; and a timer mechanism for controlling operation of the circulating means.

Preferably the chamber is dimensioned to provide a clearance of from about 15 mm to about 50 mm around the side wall(s) of the intended container, more preferably from about 20 mm to about 40 mm, and more particularly about 25 mm to about 35 mm.

Other aspects and preferred features of the invention are set forth in the accompanying claims.

The present invention will now be described, by way of example only, with reference to the following drawings, in which.

Figure 1:
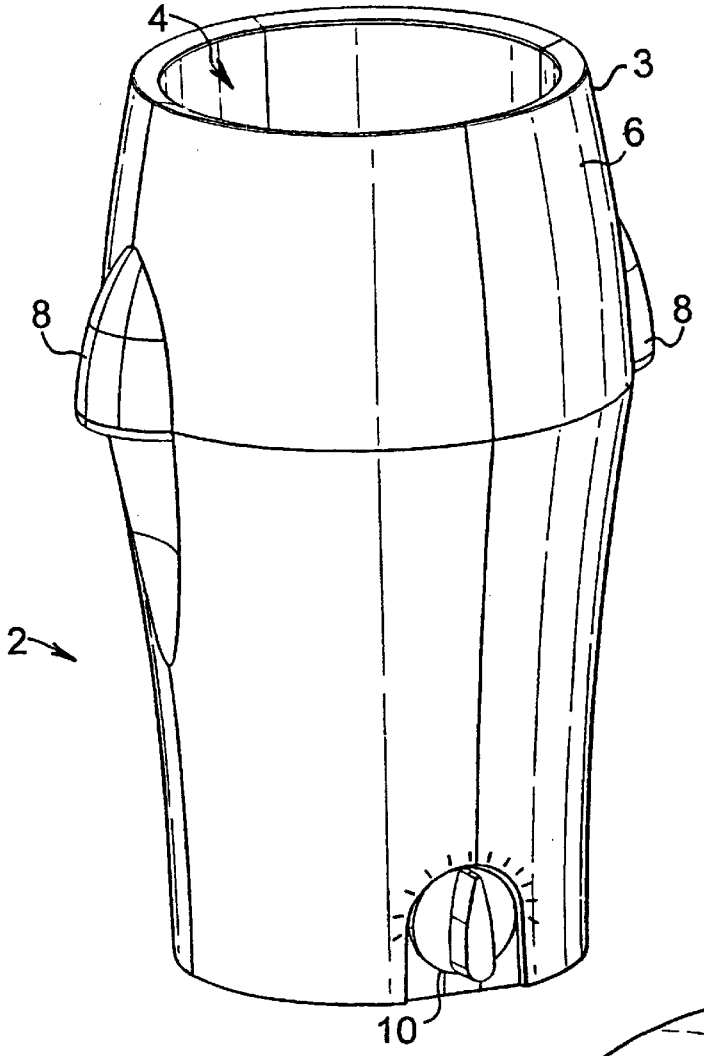
FIG. 1 shows a perspective view from one side of a cooling apparatus in accordance with the present invention.
Figure 2:
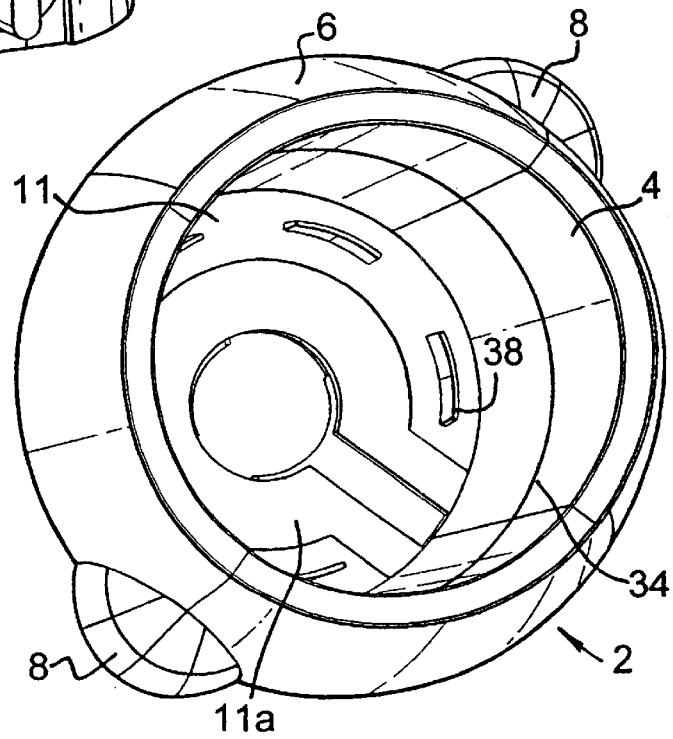
FIG. 2 shows a perspective view from above of the embodiment of FIG. 1.

Referring firstly to FIGS. 1 and 2 there can be seen a cooling apparatus shown generally as 2. The apparatus comprises housing 3 which defines a cylindrical chamber 4. The chamber 4 comprises a thermally insulative wall 6 which is formed as a double-skinned ABS plastics moulding, as will be described further below. It will be appreciated that other materials may be used for the container wall, and a double skin construction is preferred.

The outer periphery of the wall 6 includes flared portions 8 which are so formed to provide carrying handles for the apparatus 2. The flared portions 8 may also be formed on the walls of the chamber 4 even if the walls are not thermally insulative.

The lower portion of the apparatus 2 includes, in this example, a manually adjustable timer mechanism 10. The purpose of the timing mechanism 10 will be more fully described below.

Figure 3:
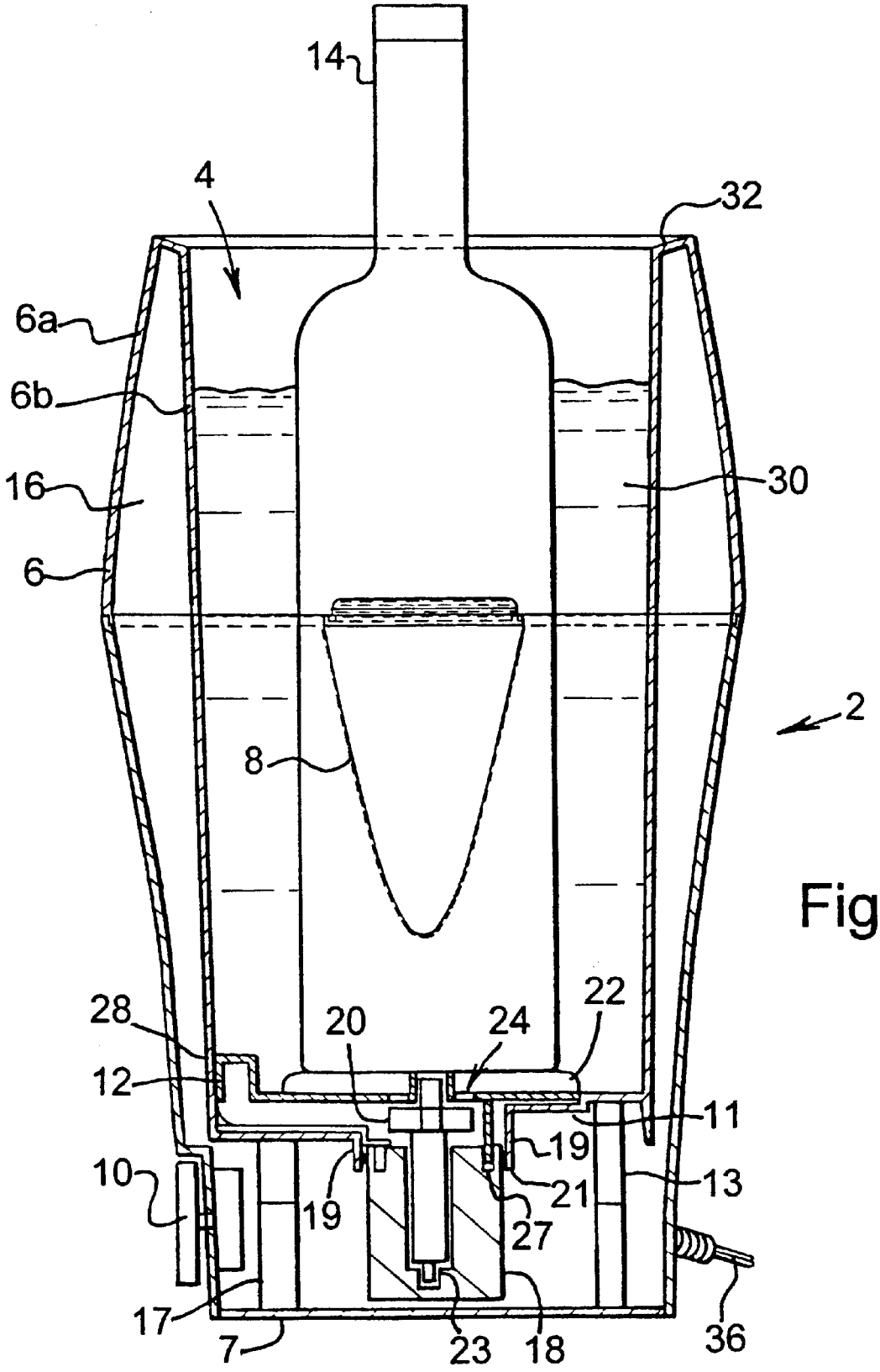
FIG. 3 shows a part-sectional view of a cooling apparatus including a wine bottle in accordance with the present invention from one side.
Figure 4:
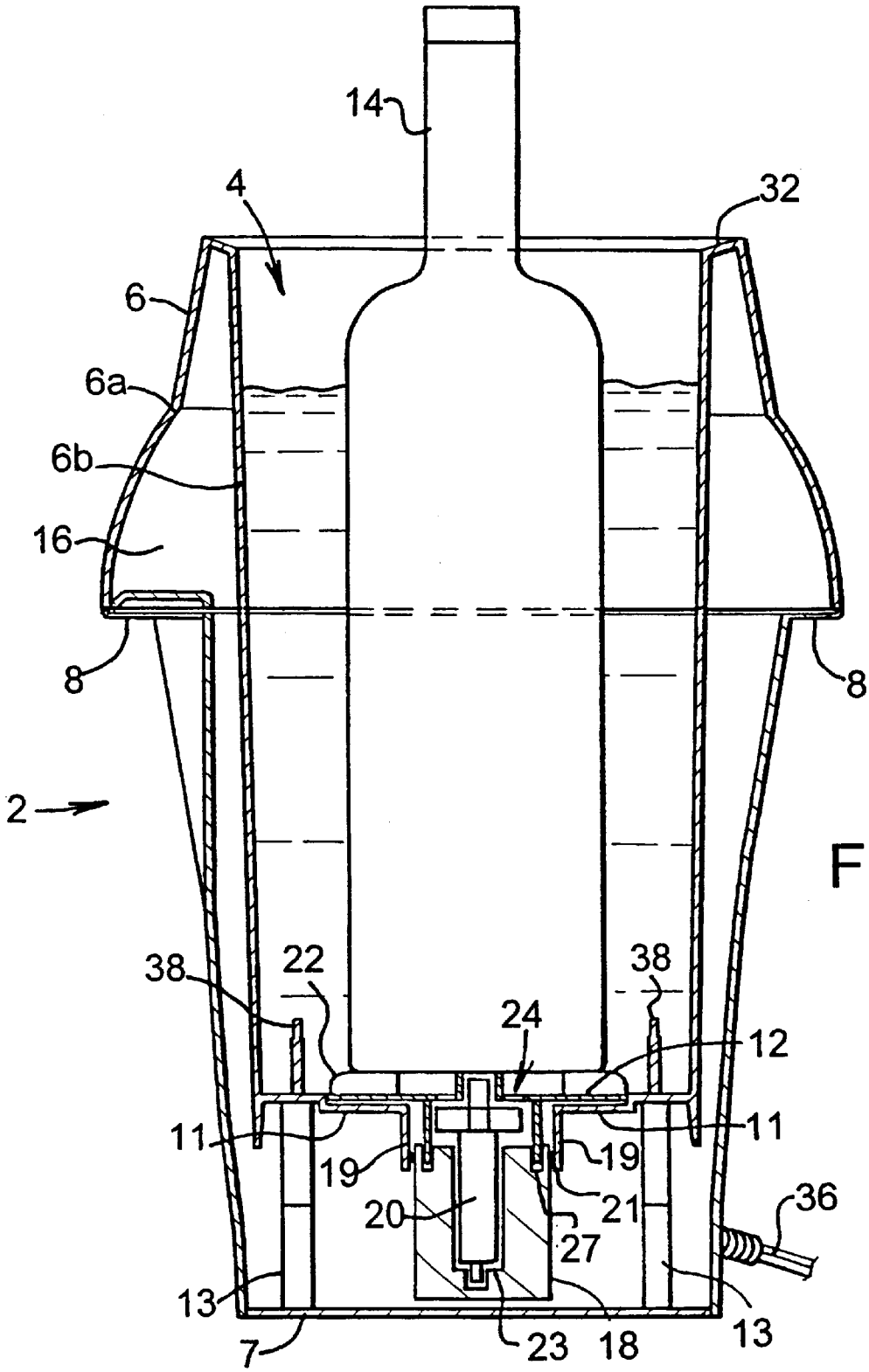
FIG. 4 shows a similar view to FIG. 3 but at 90° degrees thereto.

Referring now also to FIGS. 3 and 4 it can be seen that the inner wall 6*b* of the apparatus 2 an inner base 11 integrally formed at its lower end to define the chamber 4. The wall 11 rests upon legs 13 which protrude up from the exterior base 7, and a support member 12 rests on the inner base 11.

The support member 12 supports a container placed within the chamber, in this example a wine bottle 14 to be cooled. It will be understood that when we speak of cooling the bottle 14 it is the contents of the bottle which are desired to be cooled.

From these figures it can be seen that the thermally insulative wall 6 comprises a double-skin 6*a* and 6*b* each of which is formed from ABS plastics material as mentioned above. Between the skins 6*a* and 6*b* is trapped a pocket of air 16 which provides thermal insulation between the skins 6*a*, 6*b*.

Into the chamber 4 is poured a mixture of ice and water up to a maximum level usually determined by the size of the bottle 14. Because the chamber 4 is arranged to accommodate different size and shape containers, the volume of ice and water which needs to be poured into the chamber in order to immerse the container to a sufficient extent that cooling may take place is variable. The chamber is dimensioned to suit an intended application, in this case to act as a wine bottle cooler. Preferably the interior of the chamber has a circular cross-section in the range of from about 110 mm to about 160 mm, more preferably about 120 to about 150 mm, and particularly about 130 to about 140 mm. In this example, the chamber has a circular internal cross-section, tapering from about 140 mm diameter at the top to about 130 mm diameter at the bottom. This will accept the great majority of wine bottle sizes, typically 75 mm to 85 or 90 mm in diameter.

The chamber is deep enough to accept the major part of the container. Preferably the shoulder of a wine bottle is positioned below the rim of the chamber. In the embodiment shown, the chamber has a depth of about 250 mm, and will be filled with an ice water mixture to a depth of about 230 mm when the bottle is in place.

It is important to note, however, that no active cooling of the ice and water mixture takes place. It is only due to the ice in the water that the mixture is able to obtain and maintain a temperature of close to 0° C. The temperature obtained will depend on the quantity of ice in the mixture, and ambient conditions such as the water temperature and room temperature. There is no external refrigeration or cooling applied to the water when in the container.

It can be seen that the inner base 11 effectively partitions the apparatus 2 into two portions, an upper and a lower portion. The upper portion defines the chamber 4 in which is the bottle 14 whilst, in the lower portion is the timer mechanism 10 and a low voltage pump motor 18 for agitating the ice—water mixture within the chamber 4.

The inner base 11 has a central skirt 19 and the motor 18 is coupled to the skirt by a bayonet fitting (not shown) and an O-ring 21 forms a watertight seal between the motor and the skirt 19.

The pump is of a known type and, in this example, comprises a waterproof magnetic motor arrangement which drives an impeller 20 which is housed at its lower end in a bore 23 in the motor and journalled at its upper end in the support member 12.

Figure 5:
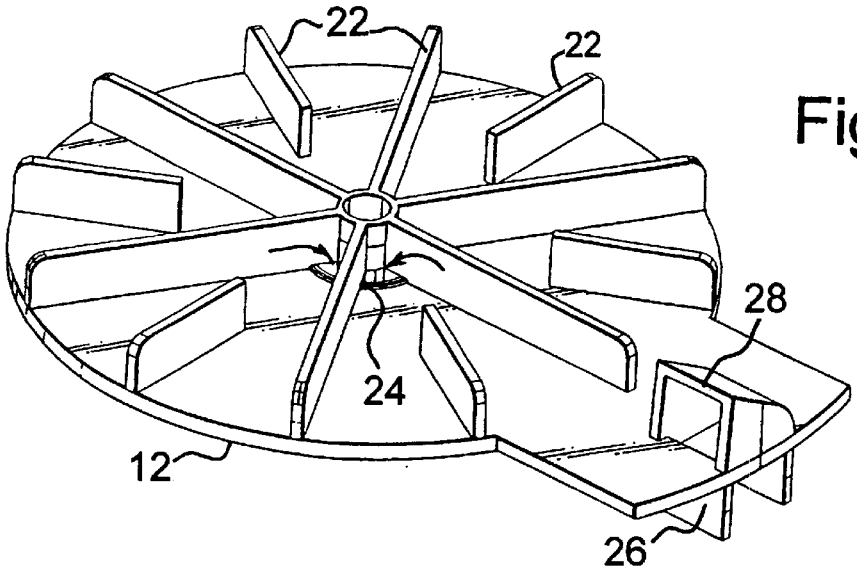
FIG. 5 shows a perspective view from above of a support member in accordance with the present invention.
Figure 6:
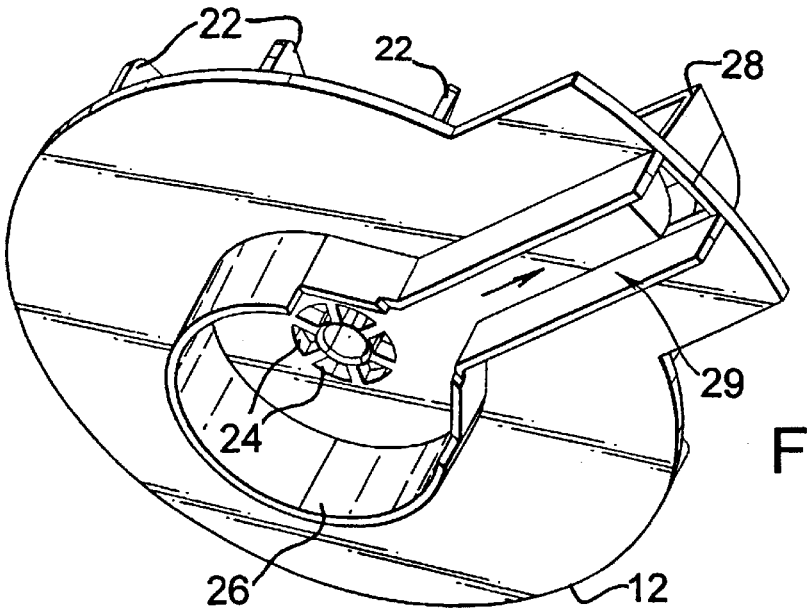
FIG. 6 shows a perspective view from below of the support member of FIG. 5.

Referring now also to FIGS. 5 and 6, the arrangement of the support member 12 and its interaction with the pump 18, 20 can be more readily understood.

The support member 12 has, on its upper surface, a plurality of ribs 22 which define a grid structure on which the bottle 14 may sit. It will be understood that the ribs 22 support the bottle 14 proud of the surface of the support member 12. This is to allow water to flow radially past the ribs 22 in the direction of the arrows shown in FIG. 5 and down through central apertures 24.

The underside of the support member 12 (as shown in FIG. 6) includes a cowling 26. Cowling 26 sits in an annular recess 27 in the top of the motor 18 and surrounds the vanes of the impeller 20, save at a channel 27. The impeller 20 (not shown in FIG. 6) draws water through the apertures 24 from the upper surface of the support member 12 to its lower surface and then forces the fluid in the direction of the arrow shown in FIG. 6 through the channel 27 and out via exit port 28 which is situated adjacent the inner skin 6*b* (see FIG. 3) in the annular gap between the bottle 14 and inner skin 6*a*. The exit port directs the water circumferentially of the chamber 4. In this manner the water is circulated in the upper portion of the chamber 4 above the support member 12. In this example, the water and ice will circulate completely around the inside of the chamber 4 about the bottle 14, if the pump 18, 20 is sufficiently powerful.

The support member 12 sits in a co-operating recess 11*a* in the base 11. The impeller 20 carries a magnet at its lower end and is driven in a non-contact manner by the pump motor 18, which is housed below the base 11, ensuring that there is complete electrical isolation between the motor power supply and the water in the chamber 4.

Figure 7:
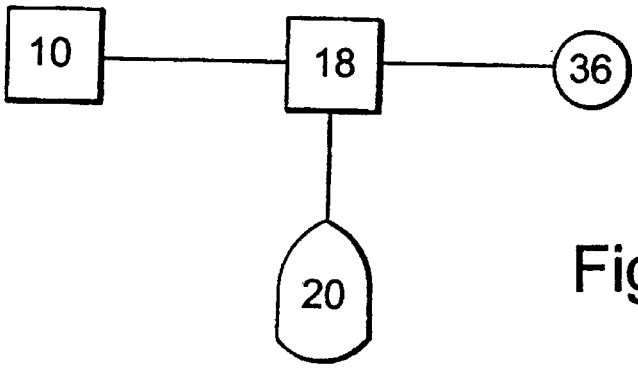
FIG. 7 shows a schematic representation of an electrical control system for an embodiment of the present invention.

In use of the cooling apparatus as herein before described, and as is shown with reference to schematic representation of FIG. 7, a user may first partially fill the chamber 4 with a mixture of ice and water, and then insert the bottle 14. Alternatively the bottle 14 may be inserted into the chamber 4 to rest upon support member 12 before adding the mixture of ice and water (the cooling fluid).

The chamber 4 may be only partially filled with ice and water(shown as 30 in FIGS. 3 and 4) particularly if the ice and water is added to the chamber 4 before insertion of the bottle 14. This will be important in order to ensure that the ice and water 30 does not overflow beyond the upper lip 32 of the chamber 4. Although this will have no effect upon the operation of the apparatus, given that it is designed particularly for use in the domestic environment, overflow of the ice and water will cause a spillage which then needs to be cleared away. For this reason, it is preferable for the inside of chamber 4 to carry a warning marking 34 to indicate the maximum level to which fluid in the chamber 4 should be filled.

Once both the ice and water 30 and the bottle 14 are positioned within the chamber 4, then the user will set the timer mechanism 10 for the desired cooling time. The timer in this example is a simple clockwork timer allowing different times to be set and operating a switch which feed a low voltage power supply from a transformer (not shown) to the motor 18 form cable 38. Although in this example the motor 18 is shown as being powered by a mains supply 36, it is possible for the motor 18 to be powered by a battery, or even clockwork, thereby making the entire apparatus 2 completely portable.

When activated, the motor of the pump 18 drives the impeller 20 which then agitates the water by re-circulating it within the container. The circulation is most preferably quite vigorous or turbulent, to provide good mixing of the ice and water, cooling the water, and to avoid a stable, wanner, layer of water remaining around the bottle. The bottle itself is likely to rotate as the water—ice mixture is circulated.

Once the timer 10 has timed-out, then the motor of the pump 18 stops and circulation of the ice and water 30 around the chamber 4 also stops.

It has been found, surprisingly, that use of a mixture of ice and water as the sole cooling fluid in the present invention, when circulated around the chamber 4, provides a much more rapid cooling of the bottle 14 than would have been the case if the cooling fluid 30 were not circulated but remained static. Indeed, it has been found that by circulating the cooling mixture 30 for between 2 and 10 minutes, and preferably for around four minutes, the contents of the bottle 14 are able to be chilled to a temperature that, had the ice and water 30 remained static, would only have been reached in around 20–30 minutes. This is particularly significant and provides an important advantage of the present invention. This is even more significant when one considers that in the prior art, refrigeration of the cooling fluid itself is usually necessary, and then this achieved to a temperature of around −20° C., depending on the ambient conditions.

Because the present invention involves no refrigeration of the cooling fluid itself, it may be important for the chamber 4 to be thermally insulated from its environment. To this end, the chamber 4 is formed, in this example, from double-skinned walls 6*a*, 6*b* with an airspace therebetween. This provides sufficient insulation for the purposes of the present invention.

In the above example, an adjustable timing mechanism 10 has been disclosed which is effective to control operation of the pump motor 18. It will be understood by those skilled in the art that the particular type of timer 10 which is chosen is not material to the present invention. So long as it is able to be set to the desired time by a user, and, in dependence upon this, controls operation of the pump 18, then any type of timing mechanism will suffice. Furthermore, there is no necessity for a timing mechanism to be present at all. The invention is equally efficacious if the pump 18 circulates the cooling fluid 30 around the bottle 14 under the user's control. Use of the timing mechanism 10 does, however, allow a user of the cooling apparatus to pre-select the duration for which the bottle 14 is to be cooled by circulation of the cooling fluid 30 before disabling of the pump 18.

In a preferred embodiment of the present invention, the chamber is dimensioned to accept a common wine bottle of standard size and shape. This means that a known clearance between the outside of the bottle and the inside of the chamber exists. This known clearance is desirable so that maximum efficiency of cooling of the bottle by the circulation of cooling fluid therearound is achieved. For example, there may be circumstances in which a laminar flow of the cooling fluid around the bottle is desirable. Alternatively, there may be circumstances when a turbulent flow is preferable.

Locating wails 38 are provided on the base 11 to ensure that the bottle is positioned away from the wall 6*a* to enable the ice-water mixture to flow completely around the outside of the bottle.

Furthermore. although a submersible magnetic pump has been described hereabove, other devices for moving the ice-water mixture will suffice. The important feature is that the mixture is moved within the chamber 4. Indeed, it can be envisaged that the pump 18, 20 need not be below the support member 12 at all. The outlet 28, for example could be housed in the upper portion of the chamber 4 and achieve the desired effect of circulation in the chamber. Other devices such as a paddle or vane might be used, rotating or oscillating to move or agitate the ice-water mixture.

The invention has been particularly described with regard to a single wine bottle, but may be applied also. for example, to a can or small pack, a four-pack for example, of cans.

What is claimed is:

1. Cooling apparatus comprising a chamber for receiving and supporting a container to be cooled, the chamber arranged to contain cooling fluid for cooling the container within the chamber; the cooling fluid consisting essentially of a mixture of ice and water; the apparatus further comprising fluid pumping means for circulating the cooling fluid around the container in the chamber.

2. Cooling apparatus according to claim 1 further comprising a timer mechanism for controlling operation of the circulating means.

3. Cooling apparatus according claim 2 wherein the timer mechanism comprises an adjustable timer.

4. Cooling apparatus according to claim 3 wherein the adjustable timer operates the circulating means when set and stops operation of the circulating means when timed-out.

5. Cooling apparatus according to claim 1, wherein the chamber has a thermally insulative wall.

6. Cooling apparatus according to claim 5, wherein the thermally insulative wall comprises a double-skinned wall of plastic material with air between the double skins.

7. Cooling apparatus according to claim 1 wherein the chamber includes a support member on which a container for cooling may be placed.

8. Cooling apparatus according to claim 7 wherein the circulating means is below the support member.

9. Cooling apparatus according to claim 8 wherein the circulating means is arranged to draw cooling fluid through a central portion of the support member and eject the drawn cooling fluid through a radially outer portion of the support member.

10. Cooling apparatus according to claim 1 wherein the chamber defines a generally circular cross-section cylinder.

11. Cooling apparatus according to claim 1 wherein the circulation means comprises a pump.

12. Cooling apparatus according to claim 11 wherein the pump is a submersible pump.

13. Cooling apparatus according to claim 1 wherein the chamber includes a flared portion on its outer wall, defining a carrying handle.

14. A method of cooling a container placed within a chamber comprising;

supporting the container on a base of the chamber, providing a mixture of ice and water within the chamber;

the container being at least partially immersed in the mixture;

agitating the mixture to move about the container.

15. A method according to claim 14 wherein the duration of agitation of the mixture is set in dependence upon the required degree of cooling of the container.

16. A method according to claim 14 wherein agitation of the mixture is achieved by pumping the mixture around the chamber.

17. A method according to claim 14, wherein a container placed within the chamber sits upon a support member housed within the chamber.

18. A wine cooler comprising a housing defining an open topped chamber for receiving and supporting a wine bottle and a mixture of ice and water for cooling the tine, and fluid pumping means for moving the ice and water relative to the chamber and the bottle.

19. A wine cooler as claimed in claim 18, wherein the housing is adapted to support the bottle at the base of the chamber.

20. A wine cooler as claimed in claim 19, wherein a support member is positioned at the base of the chamber for resting the bottle on the support member.

21. A wine cooler as claimed in claim 20, wherein an impeller is housed beneath the support member and driven to move the water in the chamber.

22. A wine cooler as claimed in claim 21, wherein an electric motor is provided to drive the impeller sufficiently rapidly to induce turbulent flow in the water and circulate it around the wine bottle.

23. A cooling apparatus for cooling a wine bottle or the like, comprising a housing having a chamber for receiving and supporting the wine bottle or the like and for receiving cold water or an ice and water mixture and an electrically driven vane within the housing and movable relative to the housing for moving the water relative to the bottle or the like.

24. Apparatus as claimed in claim 23, wherein an impeller incorporating a plurality of vanes is provided and is driven to circulate water within the housing.

* * * * *